US007243864B2

(12) United States Patent
Trapp et al.

(10) Patent No.: US 7,243,864 B2
(45) **Date of Patent: *Jul. 17, 2007**

(54) RADIO CONTROLLED LIQUID MONITOR

(75) Inventors: James M. Trapp, Galien, MI (US); Raymond A. Boissonneault, Goshen, IN (US)

(73) Assignee: Elkhart Brass Mfg. Co., Inc., Elkhart, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/270,952

(22) Filed: Nov. 11, 2005

(65) Prior Publication Data

US 2006/0091241 A1 May 4, 2006

Related U.S. Application Data

(63) Continuation of application No. 10/405,372, filed on Apr. 2, 2003, now Pat. No. 6,994,282.

(51) Int. Cl.
*B05B 15/08* (2006.01)

(52) U.S. Cl. ..... 239/587.2; 239/587.1; 239/280; 239/71; 169/24; 169/60; 285/920

(58) Field of Classification Search ..... 239/587.1, 239/587.2, 280, 456, 458, 71, 73; 169/52, 169/60, 24, 51; 285/277, 920
See application file for complete search history.

(56) References Cited

U.S. PATENT DOCUMENTS 2,360,397 A 10/1944 Carpenter
2,729,295 A 1/1956 Edwards
3,575,351 A * 4/1971 Warren ..... 239/227
3,675,721 A 7/1972 Davidson et al.
3,762,478 A 10/1973 Cummins
3,770,062 A 11/1973 Riggs
3,786,869 A 1/1974 McLoughlin
4,776,403 A 10/1988 Lejosne
4,875,526 A 10/1989 Latino et al.
4,949,794 A 8/1990 Petit et al.
5,249,632 A * 10/1993 Sparling et al. ..... 169/52
5,301,756 A 4/1994 Relyea et al.
5,593,092 A * 1/1997 McMillan et al. ..... 239/285
5,860,479 A 1/1999 LaFollette
6,786,426 B1 * 9/2004 Trapp ..... 239/71
6,994,282 B2 * 2/2006 Trapp et al. ..... 239/587.2

* cited by examiner

*Primary Examiner*—Dinh Q. Nguyen
(74) *Attorney, Agent, or Firm*—Ice Miller LLP; Michael A. Swift; Homer W. Faucett, III

(57) ABSTRACT

A radio controlled liquid monitor, capable of rotation about a vertical axis through an infinite arc is disclosed. A rotatable body is rotatably mounted onto a base element for rotation about a vertical axis, and a discharge elbow is rotatably mounted on the rotatable body for rotation about a horizontal axis. A horizontal drive unit and a vertical drive unit operate on gears on the rotatable body and the elbow, to enable the rotatable body to rotate about a vertical axis, and the discharge elbow to rotate about a horizontal axis. A control module is attached to the rotatable body which receives radio control commands from an operator via a portable transmitter apparatus or a fixed transmitter apparatus. The control module and drive unit receive electrical power and control signals through a rotating connector positioned within the base element and rotatable body so that the control module and drive units receive electrical power and control signals regardless of the rotational position of the rotatable body.

3 Claims, 18 Drawing Sheets

RADIO CONTROLLED LIQUID MONITOR

PRIORITY

This Application is a continuation of, and claims priority to, U.S. patent application Ser. No. 10/405,372, filed Apr. 2, 2003, now U.S. Pat. No. 6,994,282.

BACKGROUND

The present invention is related to water or liquid monitors, and more particularly to liquid monitors used for firefighting, airplane deicing, hydro-planting of seeds, or equipment washing, in which the ability to control the direction of flow of water from the monitor is radio controlled.

A liquid monitor is typically a tubular device which can be articulated to control the direction of water flow out of the device. In operation, one end of the device is connected to a water supply or a supply of some other type of firefighting fluid. The other end of the device terminates in a nozzle, which is used to project the fluid out of the liquid monitor in a desired direction. The water supply is typically under a pressure, thereby inducing a forceful projection of fluid out of the nozzle of the liquid monitor. A liquid monitor can typically be articulated, such that the direction of fluid projection may be changed about both a vertical axis, to enable the projection of water to be aimed in different directions. A liquid monitor is used by firefighters to project a stream of water onto burning surfaces, for purposes of fighting a fire, or to water a surface to make the surface temporarily resistant to catching fire. Liquid monitors may be mounted to a vehicle, such as a fire truck, or may be of a portable type, where a portable liquid monitor may be positioned close to a fire and attached to a hose, which supplies water to the liquid monitor. Liquid monitors may also be automated, such that an energized drive mechanism operates on the drive axes, so that the direction of the projection of water may be changed without a human operator being physically present to operate the device.

Desirable features of an automated liquid monitor include remote articulation by a wireless apparatus, unattended operation, simultaneous control of two or more liquid monitors from a centralized location, electronic control of rotational limits, programmable electronic control of oscillation, and continuous 360 degree rotation about both the drive axes.

Remote articulation of a liquid monitor using a wireless control apparatus is a desirable feature, because it allows placement and remote control of a monitor in an area deemed unsafe for firefighters to operate in, for better visibility of the liquid stream and better aiming of the stream. For example, a liquid monitor could be placed in an area of a forest close to a forest fire. The liquid monitor could continue to project fluid onto a forest fire, and could be controlled to rotate on its axes by a firefighter who could be located in a nearby safe area. The firefighter would not have to endure an increased risk of personal injury, while maintaining the ability to fight the fire.

Automatic oscillation of a liquid monitor is a desirable feature, as it would allow a firefighter to set the device in operation, and shift attention to other matters. For example, a liquid monitor could be programmed to oscillate horizontally over an arc, in order to water a fire break, or to keep a neighboring structure from catching fire. This results in less firefighter fatigue and exposure to danger, and the firefighter or team of firefighters who would normally be assigned to those tasks may now be deployed elsewhere.

Simultaneous control of two or more liquid monitors is also a desirable feature, so that control of a group of liquid monitors may be centralized at a command area. In this way, the actions of multiple liquid monitors may be controlled according to a centralized plan for fighting a fire.

Continuous 360 degree operation about the vertical axis of a liquid monitor is a desirable feature, as continuous operation allows the liquid monitor rotate in any direction, and thus project water in any direction. Often, motorized liquid monitors have external wiring to provide electricity to the motors which rotate the device in horizontal or vertical directions. This external wiring may twist around the device, eventually disabling the device, if the device were driven to rotate continuously. Eventually, continued rotation would cause damage to the external wiring. Typically in the prior art, a mechanical or electrical interlock is provided to prevent over-rotation, but such an interlock prevents the device from rotating continuously about a vertical axis. A desired feature of an improved liquid monitor includes an improved wiring structure, to enable the liquid monitor to rotate continuously in a horizontal direction.

Thus it would be a significant advance in the art to provide a liquid monitor which allows for remote control, unattended operation, simultaneous control of two or more liquid monitor devices, and continuous 360 degree rotation about a vertical axis.

BRIEF DESCRIPTION OF THE DRAWINGS

FIG. 4B1 is a cross sectional side view of the combination of the rotating slip jack and the rotating slip plug of FIGS. 2C and 3C;

FIG. 4B2 is a cross sectional side view of the combination of the rotating slip jack and the rotating slip plug of FIGS. 2C and 3C taken along line B2—B2 of FIG. 4B1;

DETAILED DESCRIPTION

Figure 1A:
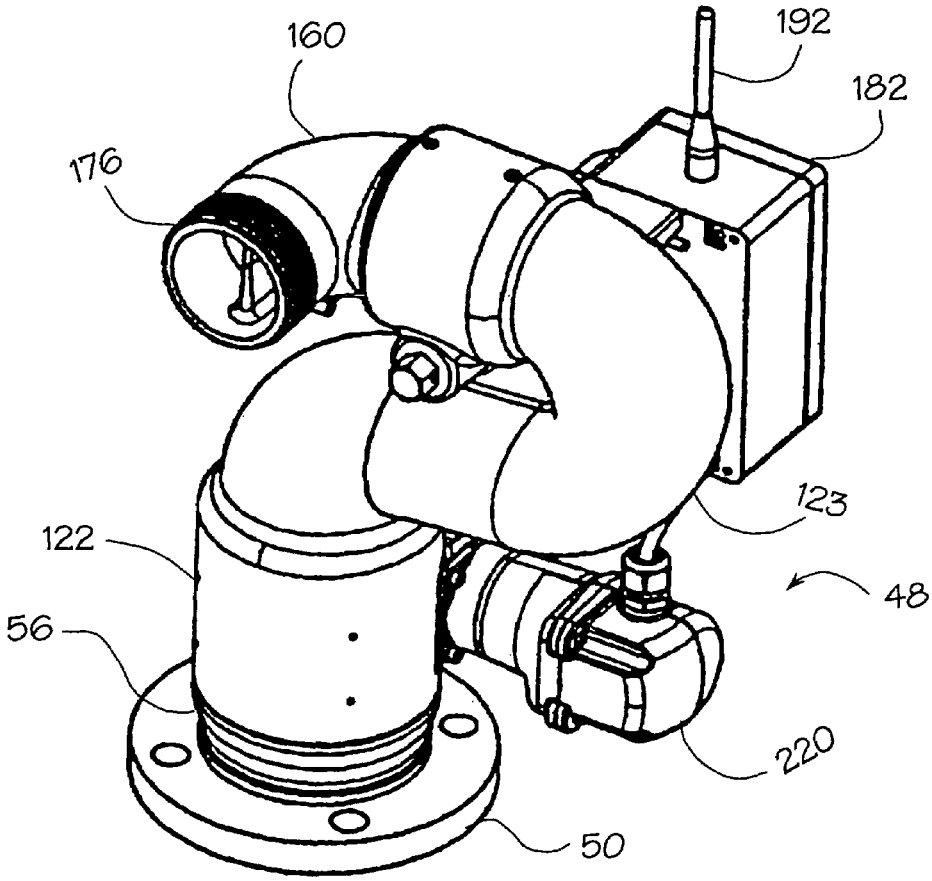
FIG. 1A is a front upper perspective view of a radio controlled monitor.

In accordance with the present invention, a preferred embodiment of a radio controlled monitor is provided as shown in FIG. 1A, and is generally denoted as numeral 48.

With reference to FIGS. 1A, 1B, 1C, 1D, 1E, and 1F, a base element 56 comprises a base flange 50, to provide a sturdy base for operation. A monitor body 122 is rotatably mounted on the base element 56. Monitor body 122 comprises a curved hollow tubular structure 123, and a discharge elbow 160 is rotatably mounted into the end of curved tubular structure 123. A horizontal drive unit 220 and a vertical drive unit 282 operate to engage gear teeth 60 on the base element 56 and gear teeth 162 on discharge elbow 160, to enable the monitor body 122 to rotate horizontally about a vertical axis, and the discharge elbow 160 to rotate vertically about a horizontal axis. An electronic control module 184, inserted into an electronics housing 182 and attached to the body 123, receives commands from a human operator via a portable transmitter apparatus 400 or a fixed transmitter apparatus 460. The control module 184 receives electricity from wires which extend from the electronics housing 182, through an upper rotating connector section 98 and a lower rotating connector section 70, and out of the base element 56. The wires of the rotating connector section 98 can also be used to convey control signals to the control module 184. Thus, the control module 184 may continue to receive electricity and control signals, even if the monitor body 122 is undergoing continuous horizontal rotation.

Figure 1B:
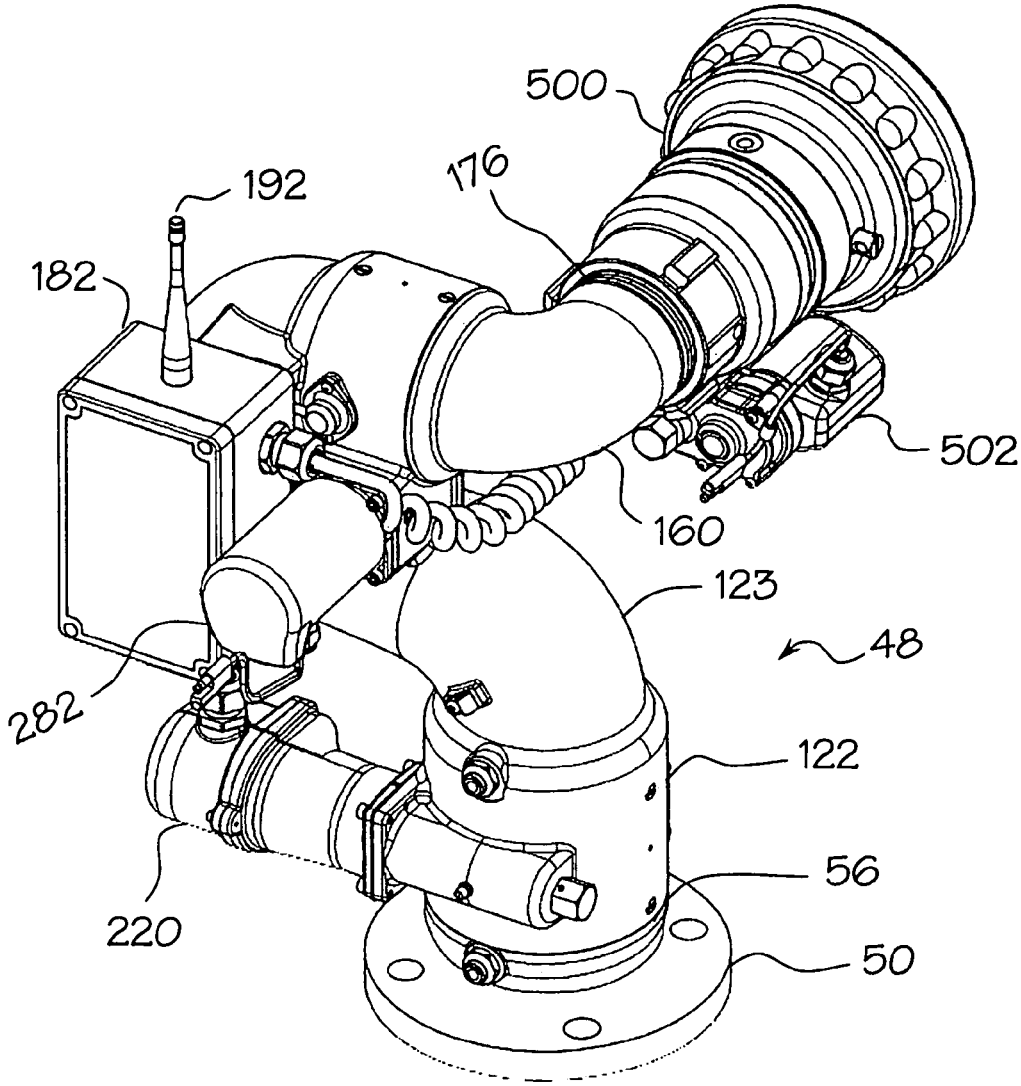
FIG. 1B is a rear upper perspective view of the radio controlled monitor in FIG. 1A with a nozzle attached at the discharge end.
Figure 1C:
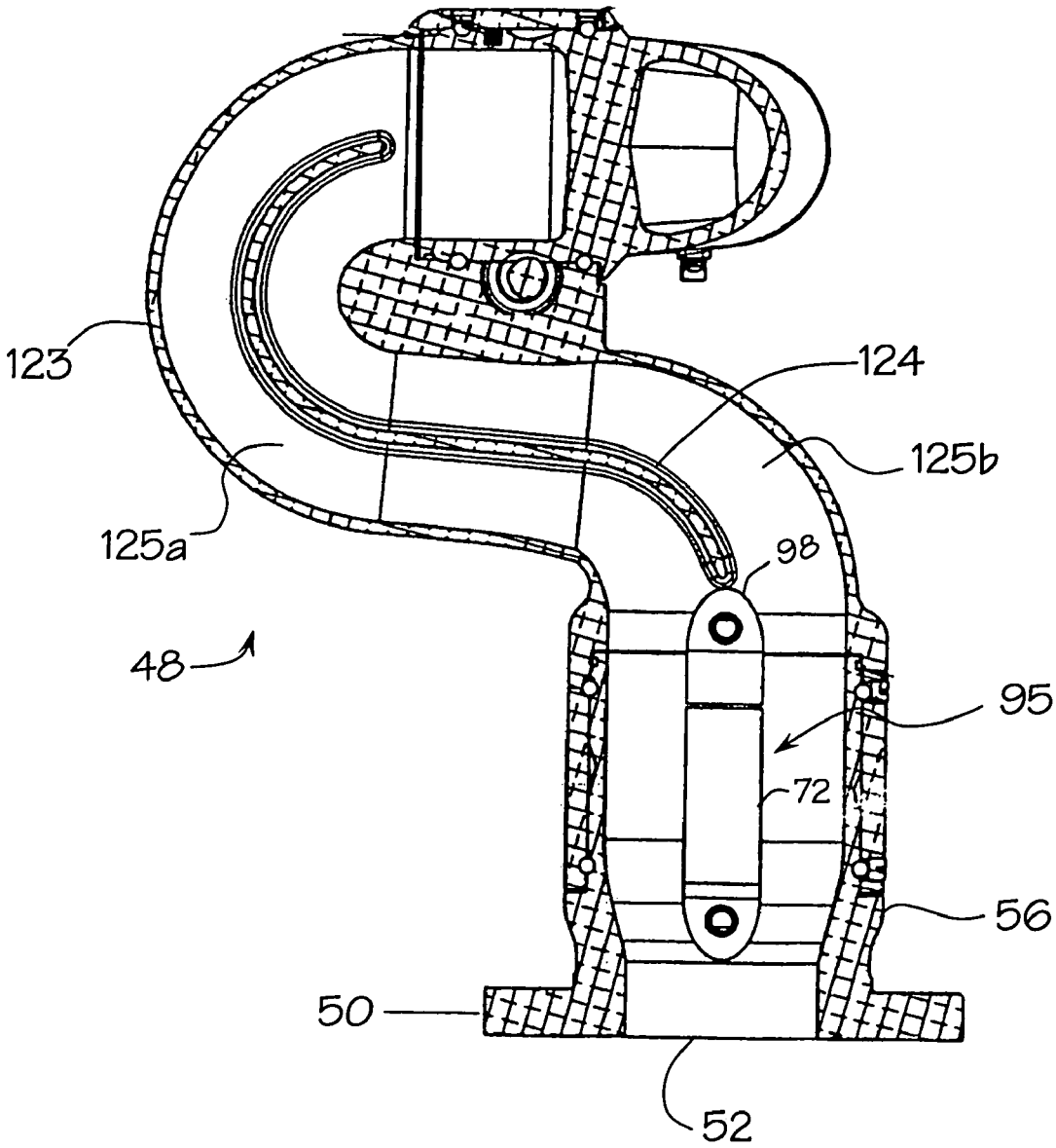
FIG. 1C is a rear cross sectional view of the radio controlled monitor in FIG. 1A.
Figure 1D:
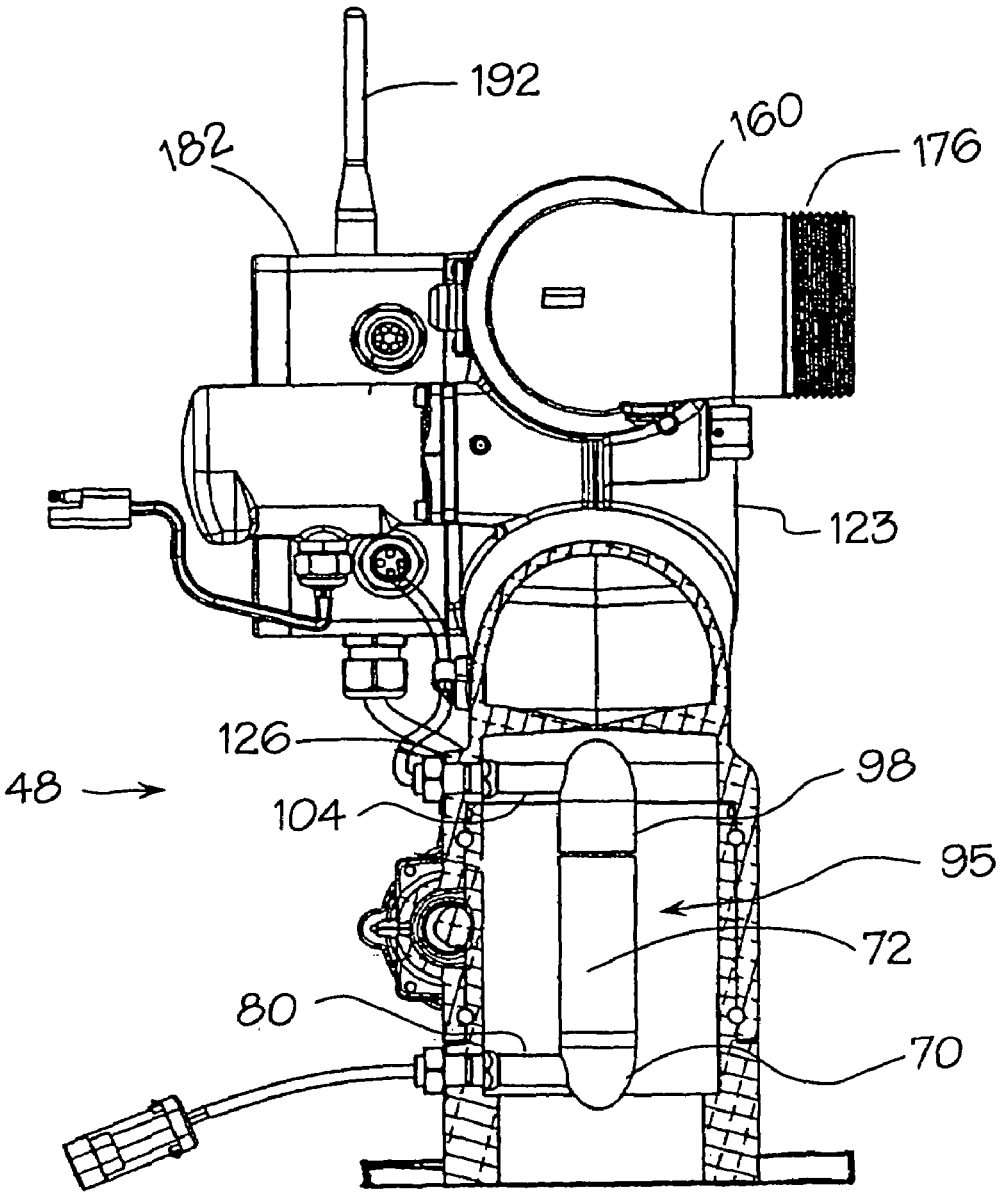
FIG. 1D is a partially cross sectional side view of the radio controlled monitor in FIG. 1A.
Figure 1E:
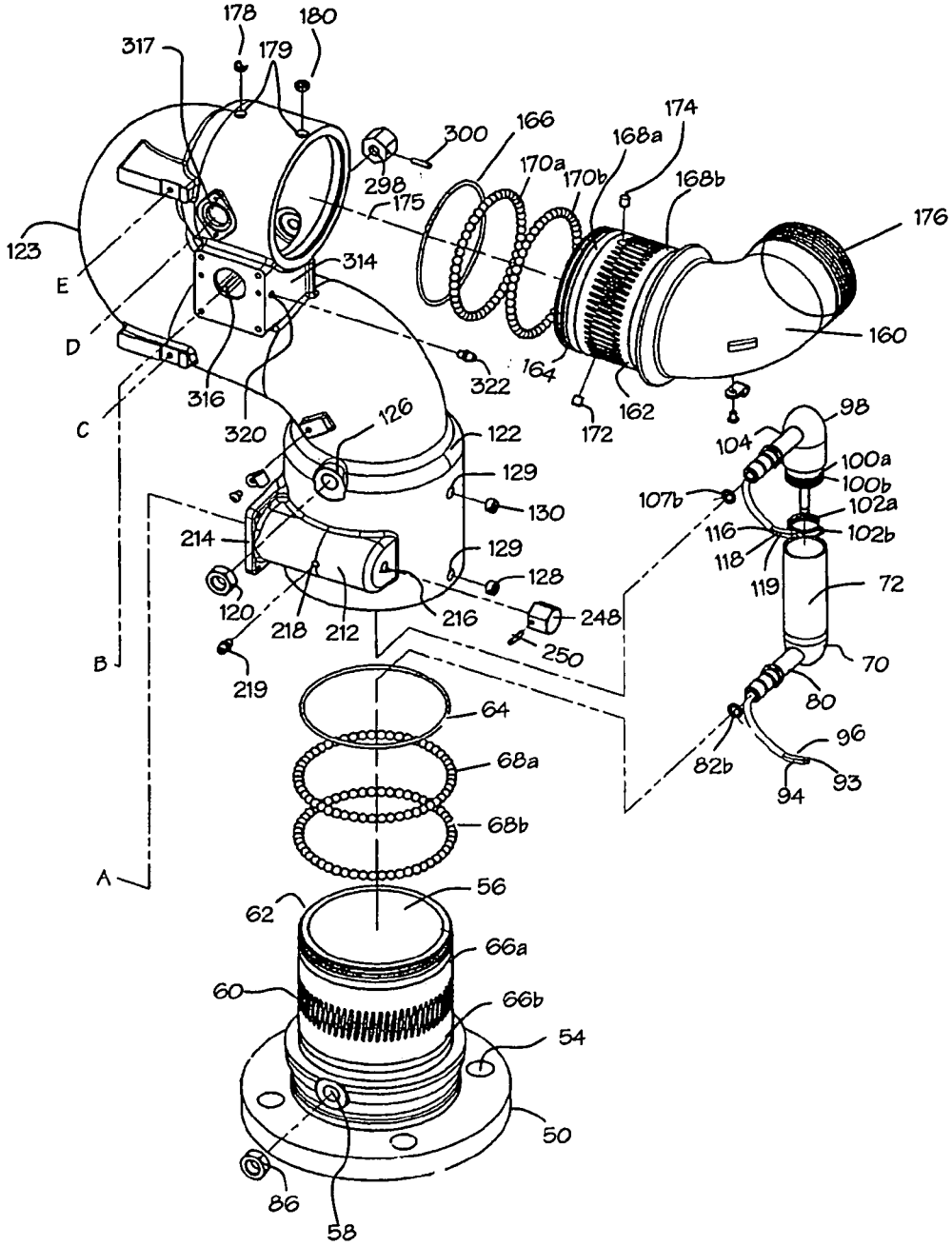
FIG. 1E is a partial exploded perspective view of the radio controlled monitor of FIG. 1A.

Referring to FIGS. 1A, 1D, and 1E, the base element 56 is a hollow cylindrical tube with a flange 50 at one end. A large opening 52 at the base of flange 50 allows fluid from a source of fluid (not shown) to flow through base element 56. A plurality of smaller openings 54 are formed in flange 50, into which bolts (not shown) may be inserted to securely fasten the base flange 50 to a base structure (not shown).

The inner diameter of the cylindrical base element 56 is slightly larger than the diameter of the large opening 52 of the base flange 50. The base element 56 is integrally formed with a base flange 50 so that the opening 52 of the base flange 50 aligns with the hollow interior of cylindrical base element 56. A base element aperture 58 (see FIG. 1E) is formed in the cylindrical wall of the base element 56. Circumscribed about the outside of the base element 56 are base element gear teeth 60, with a thread pattern designed to interface with a worm shaft 252 of a drive unit 220 (FIG. 1F), which will be discussed in more detail below. Also circumscribed about the outside of the base element 56, near the open upper end of the base element 56 is a base element O-ring groove 62, a first base element bearing groove 66*a*, and a second base element bearing groove 66*b*.

The monitor body 122 is also cylindrical, and dimensioned to fit over base element 56. Hollow tubular body 123 is connected to body 122 and has a 90 degree bend and a 180 degree bend, in an approximate "S" shape. An internal divider 124 is formed within the tubular body 123 (FIG. 1C), which creates two separate channels 125*a* and 125*b* within the body 123. The internal diameter of the lower section of the monitor body 122 is slightly greater than the external diameter of the base element 56 so that monitor body 122 can be placed over base element 56 and rotated.

A base element O-ring 64 is placed into the base element O-ring groove 62 and a first set of ball bearings 68*a*, and a second set of ball bearings 68*b* are placed into the first base element bearing groove 66*a* and the second base element bearing groove 66*b*, respectively through openings 129 in monitor body 122. The monitor body 122 is positioned over the base element 56 such that the base element O-ring 62 is compressed against the inside of the monitor body 122, creating a fluid-tight seal between the base element 56 and the monitor body 122. The base element gear teeth 60 are thus positioned adjacent the inner walls of the monitor body 122. The first set of ball bearings 68*a* and the second set of ball bearings 68*b* provide roller bearing support to allow the monitor body 122 to rotate around the base element 56. Free horizontal rotation of the monitor body 122 about the base element 56 is thus possible. A first set screw 128 and a second set screw 130 are screwed into threaded openings 129 in the monitor body 122, to retain the ball bearings within grooves 66*a* and 66*b*, and retain the monitor body 122 on base element 56.

The discharge elbow 160 is hollow, tubular and is curved 90 degrees. Circumscribed about the outside of the base of discharge elbow 160 are discharge elbow gear teeth 162, with a thread pattern designed to interface with a vertical worm shaft 290 of drive unit 282 (FIG. 1F), which will be discussed in more detail below. Also circumscribed about the outside of the discharge elbow 160, near the base end of the elbow 160, is a discharge elbow O-ring groove 164, a first discharge elbow bearing groove 168*a*, and a second discharge elbow bearing groove 168*b*. Positioned into recesses in the discharge elbow 160 adjacent gear teeth 162 are a first magnet 172 and a second magnet 174. Circumscribed about the opposite end of the discharge elbow 160 are threads 176. The threads 176 are designed to engage a complimentary thread pattern inscribed along the inner walls of an accessory item (not shown), such as a nozzle or baffle which can alter the direction or the spray characteristics of the fluid ejected from the radio controlled monitor 48.

With reference to FIG. 1B, nozzle 500 is shown threaded onto threads 170 at the discharge end of elbow 160. Nozzle 500 is a conventional adjustable nozzle well know to the art that can be adjusted to vary the pattern of discharge from a steady narrow stream to a wider spray, to a fine mist or fog. Attached to nozzle 500 is a nozzle adjusting motor 502 which is operable under the control of control module 184 to control the pattern of the spray of nozzle 500.

A discharge elbow O-ring 166 is placed into the discharge elbow O-ring groove 164, and a set of ball bearings 170*a*, and a second set of ball bearings 170*b* are placed in the first discharge elbow bearing groove 168*a*, and the second discharge elbow bearing groove 168*b*, respectively through openings 179 in body 123. The discharge elbow 160 is inserted into the open end of the body 123 such that the discharge elbow O-ring 166 in the discharge elbow O-ring groove 164 is compressed against the inside of the body 123, creating a fluid-tight seal between the discharge elbow 160 and the body 123. The discharge elbow gear teeth 162 are thus positioned against the inner walls of the body 123. The first set of ball bearings 170*a* and the second set of ball bearings 170*b* provide roller bearing support to allow rotation of the discharge elbow 160 upon the body 123. Free rotation of the discharge elbow 160 about a horizontal axis 175 is thus possible. A third set screw 178 and a fourth set screw 180 are inserted into openings 179 in the body 123 to retain the bearings in grooves 168*a* and 168*b* so that the bearings retain the discharge elbow 160 inside body 123.

With reference to FIG. 1D, rotatable connector 95 is shown as positioned within base element 56 and body 122. The upper rotating connector section 98 is deposited inside the monitor body 122, such that the cylindrical upper rotating connector section 98 is centered in the monitor body 122. Additionally, the upper connecting tube 104 of the upper rotating connector section 98 is inserted into the monitor body aperture 126, such that the end of tube 104 is positioned through the monitor body 126 and extends outside of the monitor body 122. Upper connecting tube O-ring 107*b* (FIG. 1E) is compressed against the walls of groove 107*a* and the monitor body aperture 126, such that a liquid-tight seal is created between the second upper connecting tube O-ring 107*b* and the walls of the monitor body aperture 126. An upper jam nut 120 engages threads on tube 104, to secure the upper rotating connector section 98 to the monitor body 122.

Figure 2A:
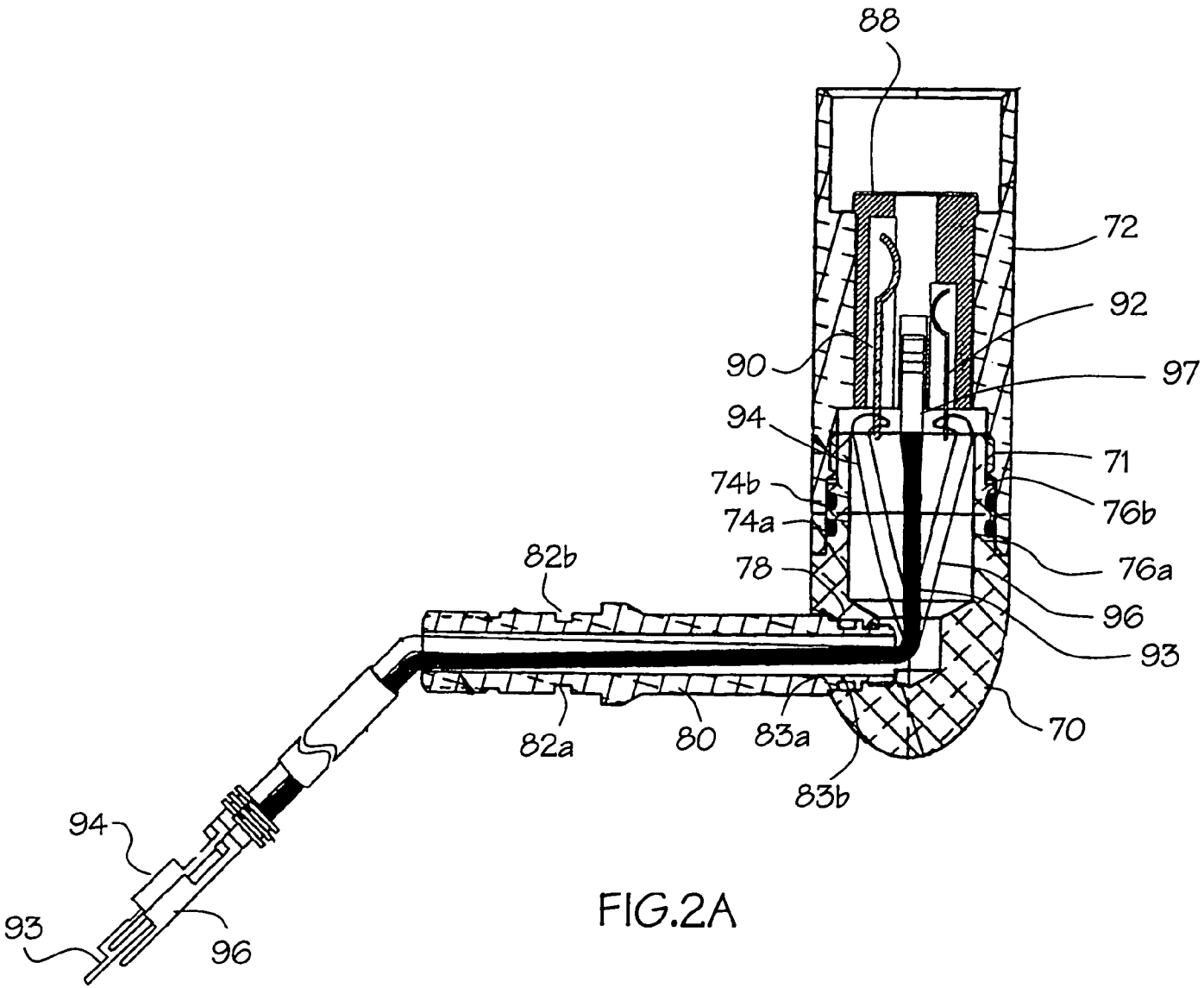
FIG. 2A is a cross sectional side view of a lower rotating connector section of the radio controlled monitor of FIG. 1A.
Figure 2B:
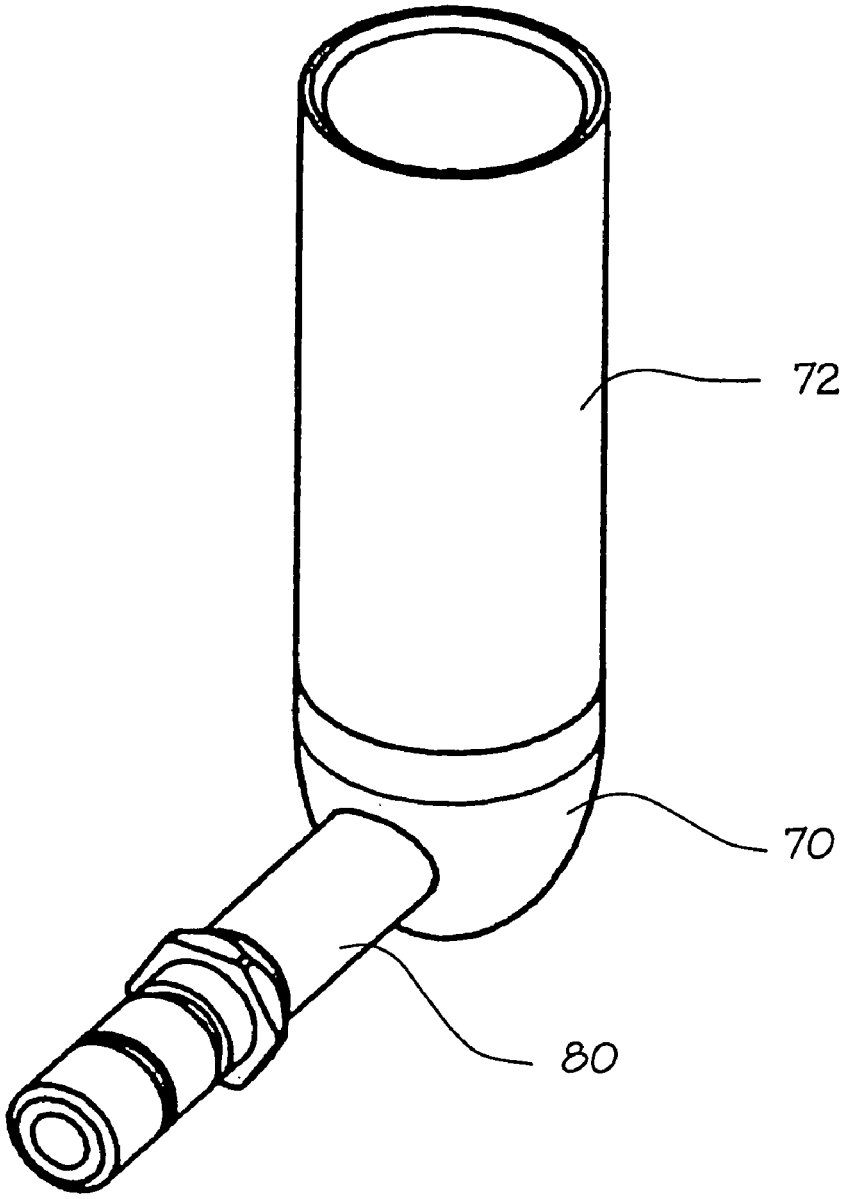
FIG. 2B is a side upper perspective view of a lower rotating connector section of the radio controlled monitor of FIG. 1A.
Figure 2C:
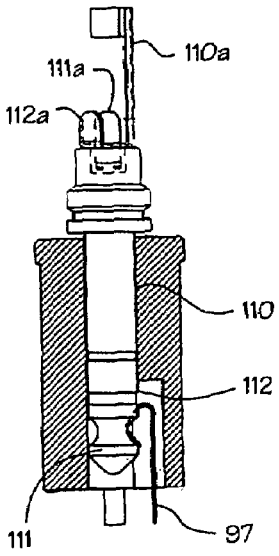
FIG. 2C is a cross sectional side view of the rotating slip ring jack of FIG. 2A.
Figure 2C:
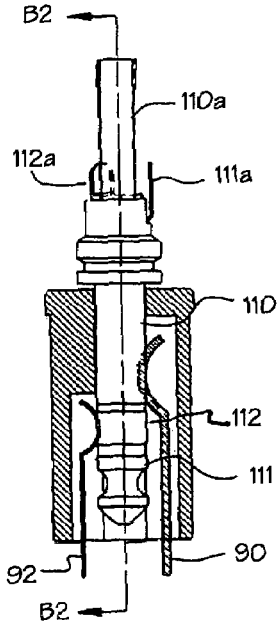
Figure 2C:
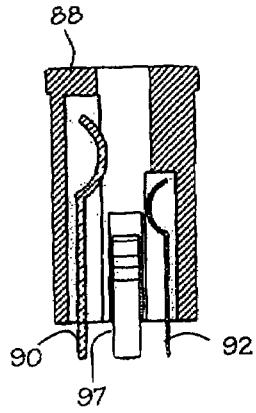

Referring now to FIGS. 2A, 2B, and 2C, the lower rotating connector section 70 is a hollow cylinder which is closed at one end. The interior of the open cylindrical end of the lower rotating connector section 70 is circumscribed with threads 71. An extending cylinder 72 is of a similar external diameter as the lower rotating connector section 70 and has threads, of a complimentary thread pattern to the threads of the lower rotating connector section 70, formed along the inside of the extending cylinder 72. A first extending cylinder O-ring groove 76*a* and a second extending cylinder O-ring groove 76*b* are formed around the exterior edge of section 70. A first extending cylinder O-ring 74*a* and a second extending cylinder O-ring 74*b*, made of an elastomeric material, are placed into the first extending cylinder O-ring groove 76*a* and the second extending cylinder O-ring groove 76*b*, respectively. The threads of the lower rotating connector section 70 are engaged with the threads of the extending cylinder 72, such that the first extending cylinder O-ring 74*a* and the second extending cylinder O-ring 74*b* compress against the lower rotating connector section 70, forming a fluid-tight seal.

An aperture 78 is formed in the lower rotating connector section 70, and threads are formed along the inside of aperture 78. A hollow, cylindrical lower connecting tube 80 is threaded at both ends and one end is threaded into aperture 78. The hollow interior of tube 80 communicates through aperture 78 to the hollow interior of the closed end of the lower rotating connector section 70. The outer diameter of the lower connecting tube 80 is slightly smaller than the diameter of the aperture 58 in base element 50. The lower connecting tube 80 is circumscribed at one end with a first lower connecting tube O-ring groove 82*a*, and at the other end with O-ring groove 83*a*. A first lower connecting tube O-ring 82*b* and a second lower connecting tube O-ring 83*b*, made of an elastomeric material, are deposited therein, respectively. Both ends of the lower connecting tube 80 have threads formed thereon. The threads of one end of the lower connecting tube 80 are engaged with the threads in threaded aperture 78, such that the first lower connecting tube O-ring 82*b* compresses against the lower rotating connector section aperture walls, forming a fluid-tight seal. The lower rotating connector section 70 is deposited inside the cylindrical base element 56, such that the cylindrical lower rotating connector section 70 is centered in the cylindrical base element 56. Additionally, tube 80 of the lower rotating connector section 70 is inserted through the base element aperture 58, such that the end of the lower connecting tube 80 is outside the base element 56. The second lower connecting tube O-ring 82*b* is compressed against the walls of the base element aperture 58, such that a water-tight seal is created between the second lower connecting tube 80 and the walls of the base element aperture 58. A lower jam nut 86 is engaged with the threads on the end of tube 80, to secure the lower rotating connector section 70 to the base element 56.

With reference to FIGS. 2A and 2C, positioned within the lower rotating connector 72 is a hollow rotating slip ring jack 88. The rotating slip ring jack 88 is essentially a hollow cylinder, and is made from an electrically insulating material. Molded into the inner walls of the cylindrical rotating slip ring jack 88 are a first conductive brush 90, a second conductive brush 92, and third conductive brush with securing detents 97. A first wire 94 is attached to the first conductive brush 90, and a second wire 96 is attached to the second conductive brush 92, and a third wire 93 is attached to third conductive brush 97. The first wire 94, the second wire 96 and third wire 93 are electrically shielded, except where the first wire 94, second wire 96 and third wire 93 attach to the first conductive brush 90, the second conductive brush 92, and third conductive brush 97 respectively. The first wire 94, second wire 96 and third wire 93 extend from the rotating slip ring jack 88, through the cylindrical lower rotating connector section 70, through the cylindrical tube 80, and out of the cylindrical base element 56.

Figure 3C:
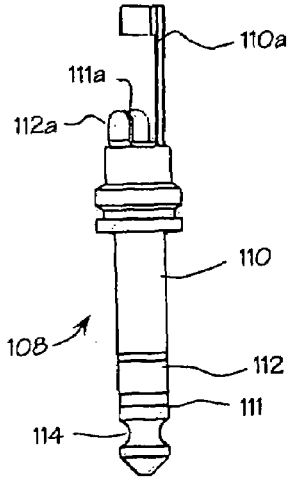
FIG. 3C is a cross sectional side view of the rotating slip ring plug of FIG. 3A.
Figure 3A:
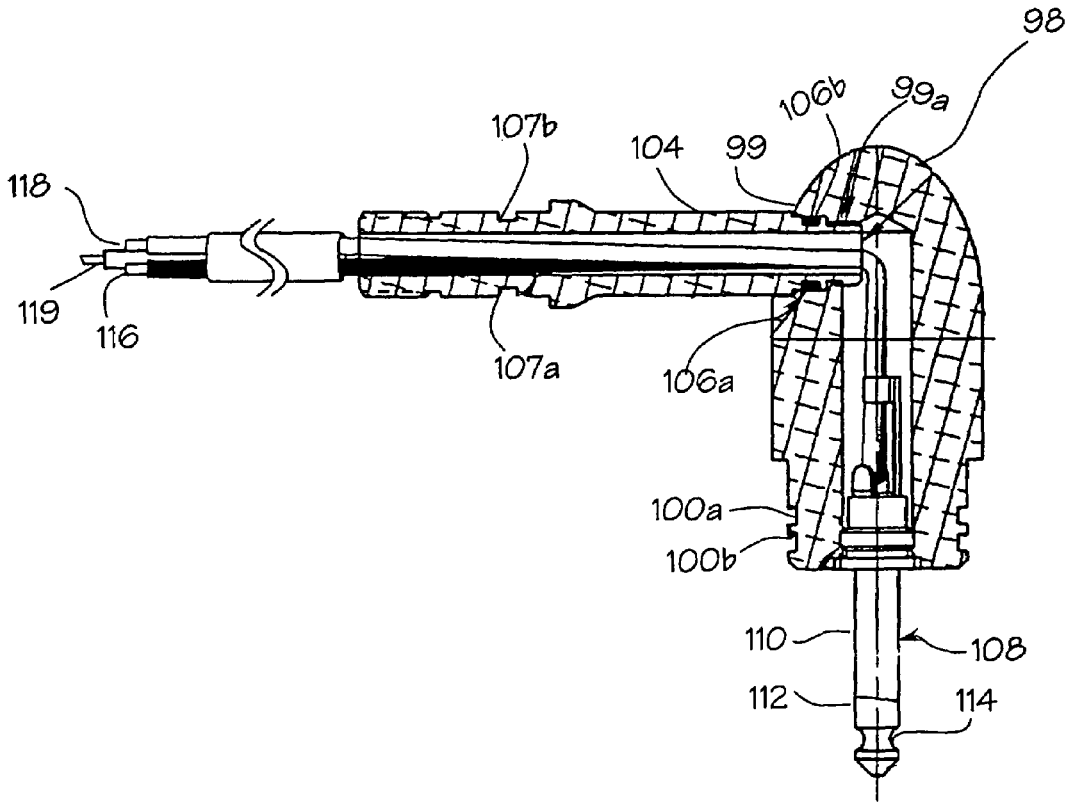
FIG. 3A is a cross sectional side view of an upper rotating connector section of the radio controlled monitor of FIG. 1A.
Figure 3B:
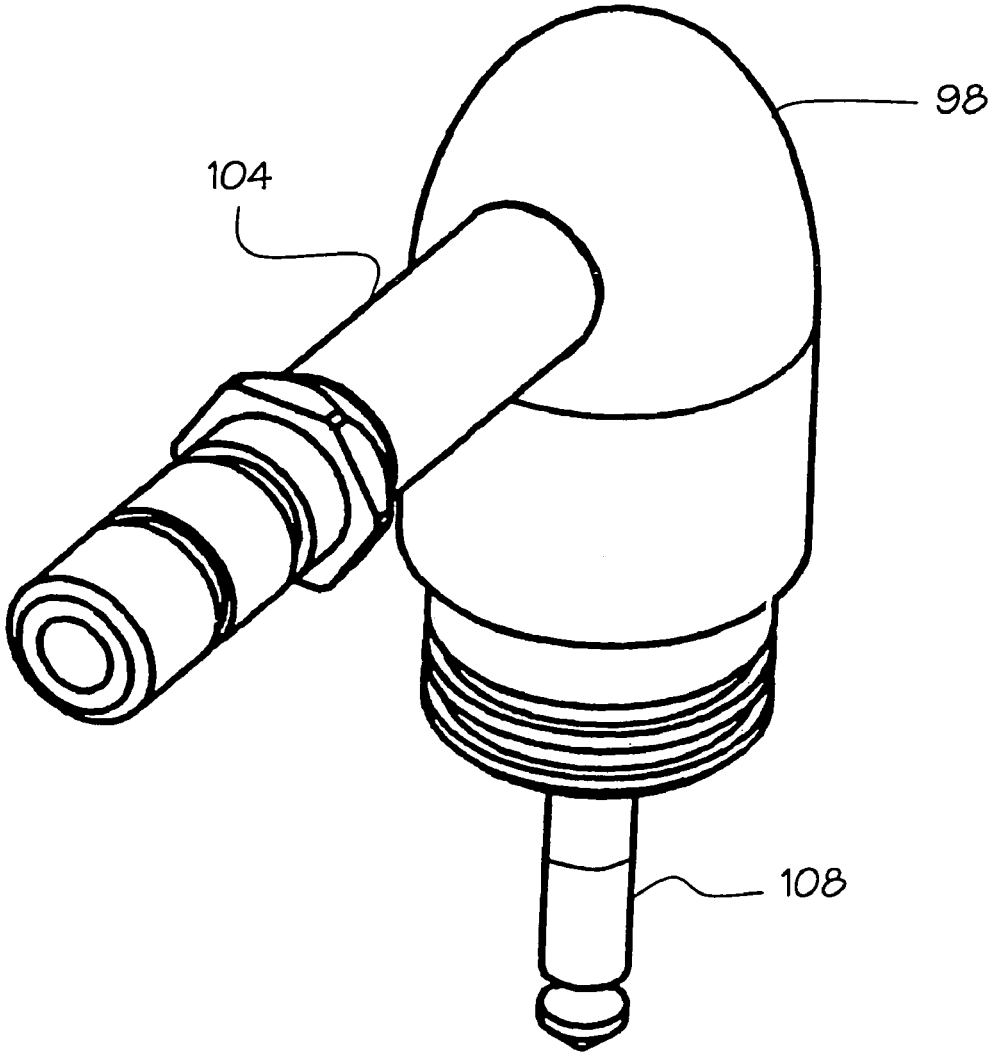
FIG. 3B is a side upper perspective view of the upper rotating connector section of the radio controlled monitor of FIG. 1A.
Figure 4A:
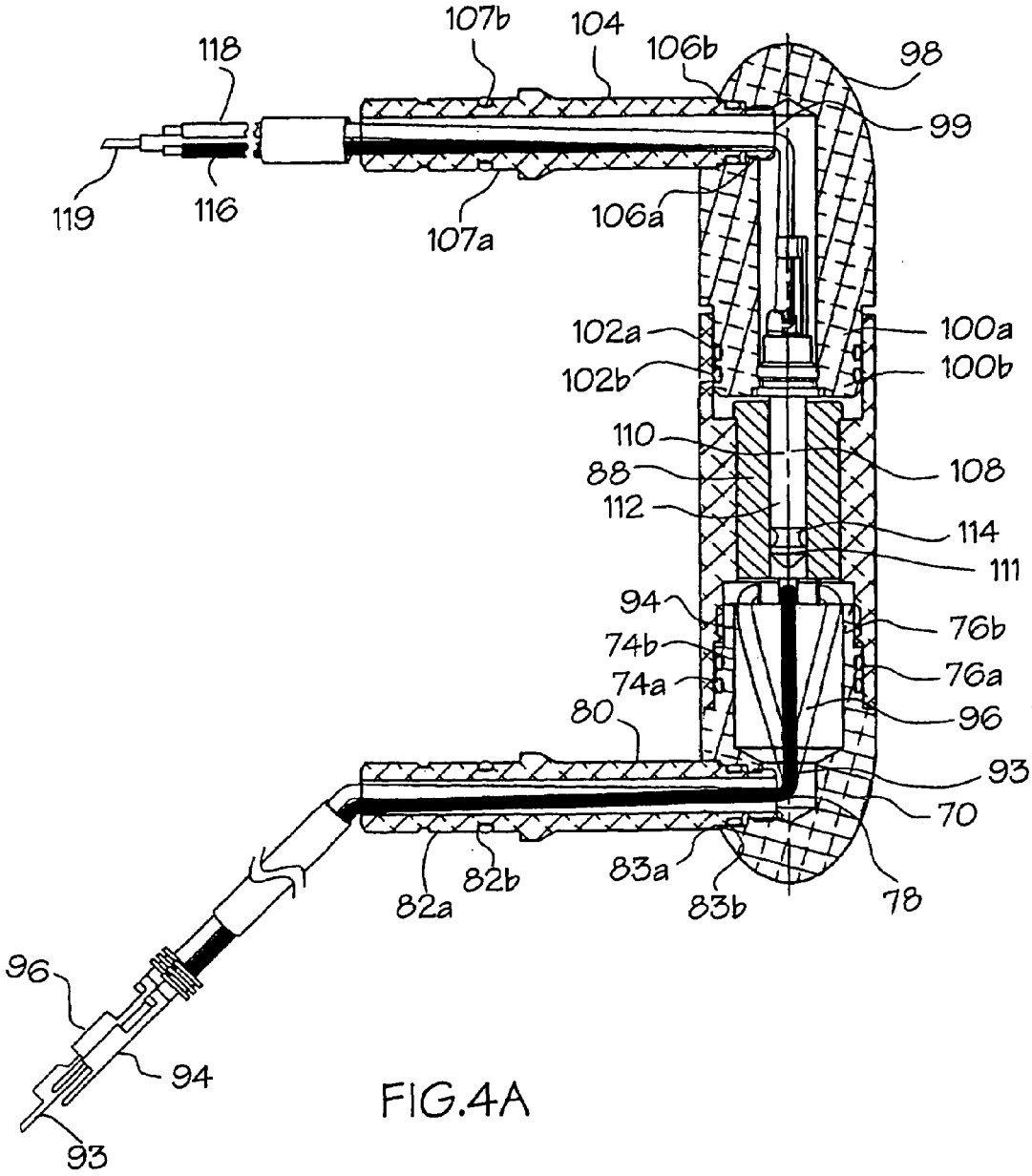
FIG. 4A is a cross sectional side view of the combination of the upper rotating connector section and the lower rotating connector section of FIGS. 2A and 3A.
Figure 4C:
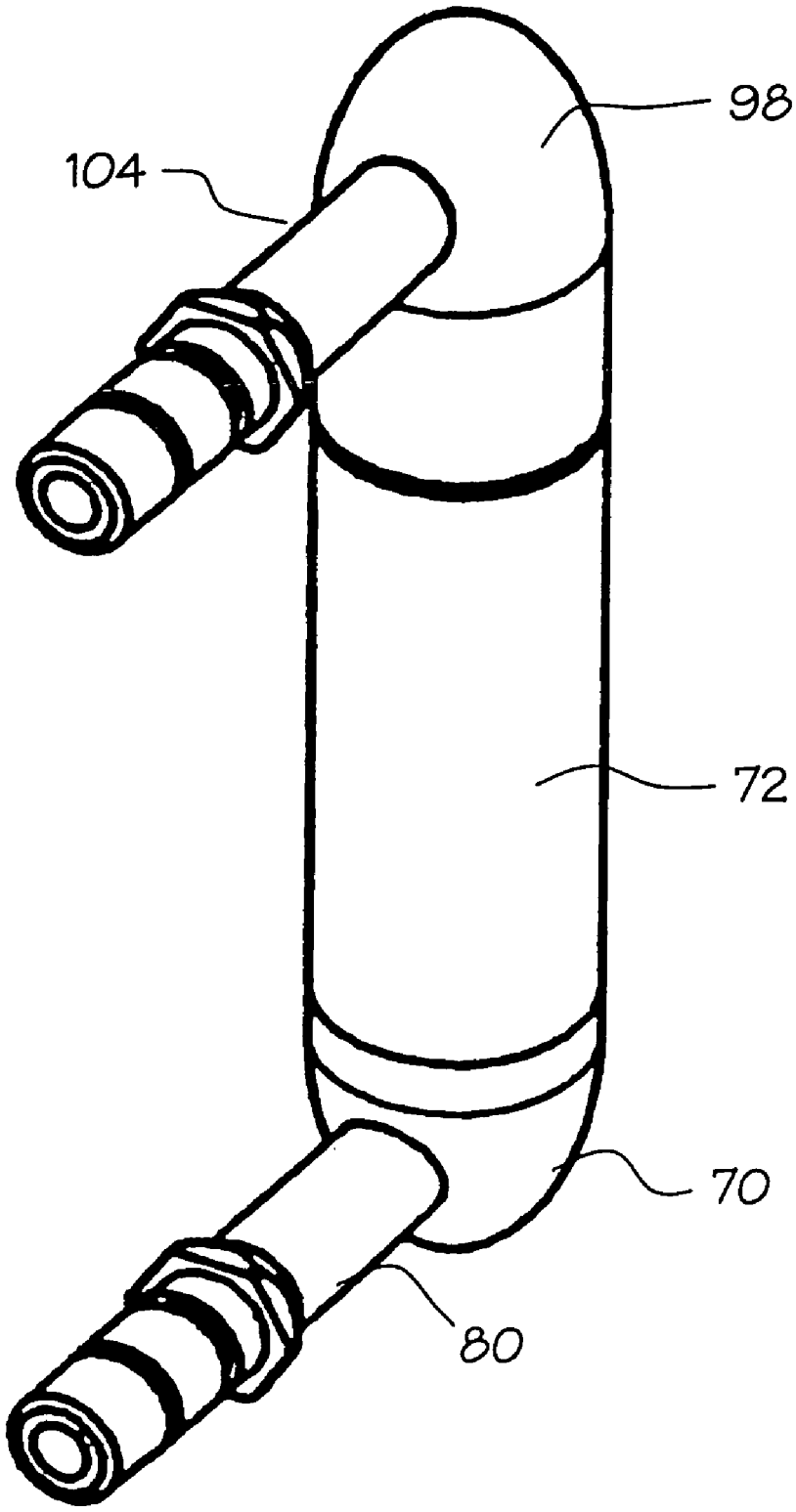
FIG. 4C is a side upper perspective view of the combination of the upper rotating connector section and the lower rotating connector section of FIGS. 2B and 3B.

Referring now to FIGS. 3A, 3B, and 3C, the upper rotating connector section 98 is a hollow cylinder which is closed at one end. The open cylindrical end of the upper rotating connector section 98 is circumscribed with a first O-ring groove 100*a* and a second O-ring groove 100*b* into which O-rings 102*a* and 102*b* are placed (see FIG. 4A). An aperture 99 is formed through the upper rotating connector section 98, and threads 99*a* are formed along the inside of aperture 99. A hollow cylindrical upper connecting tube 104 has an outer diameter slightly smaller than the diameter of the aperture 126 in body 122. The tube 104 is circumscribed at one end with a first upper connecting tube O-ring groove 106*a*, and at the other end with a second upper connecting tube O-ring groove 107*a*. A first upper connecting tube O-ring 106*b* and a second upper connecting tube O-ring 107*b*, each formed of an elastomeric material, are placed into the first upper connecting tube O-ring groove 106*a* and the second upper connecting tube O-ring groove 107*a*, respectively. Both ends of the upper connecting tube 104 also have threads formed thereon. The threads of one end of the upper connecting tube 104 are engaged with the threads 99*a* in aperture 99, such that the first upper connecting tube O-ring 106*b* in the first upper connecting tube O-ring groove 106*a* compresses against the walls of the upper rotating connector section aperture, forming a fluid-tight seal.

A rotating slip ring plug 108 is attached to the open cylindrical end of the upper rotating connector 98. The rotating slip ring plug 108 is cylindrical, and the cylinder of the rotating slip ring plug 108 is comprised of alternating electrically conductive and electrically insulating materials, such that a first conductive section 110, a second conductive section 112 and a third conductive portion 111 are formed. With reference to FIG. 3C, the rotating slip ring plug 108 ends in a tapered section with a groove 114 formed around the end of ring plug 108. First conductive section 110 is connected to a contact 110*a*, second conductive section 112 is connected to contact 112*a* and a third conductive portion 111 is connected to contact 111*a*. A fourth wire 116 is attached to contact 110*a*, a fifth wire 118 is attached to contact 112*a* and sixth wire 119 is connected to contact 11*a* so that the fourth wire 116 is electrically connected to the first conductive section 110, the fifth wire 118 is electrically connected to the second conductive section 112 and the sixth wire 119 is electrically connected to the third conductive section 111. The fourth wire 116, fifth wire 118 and sixth wire 119 are electrically shielded, except where the fourth wire 116, fifth wire 118 and sixth wire 119 attach to the contact 110*a*, second contact 112*a*, and third contact 111*a* respectively. The fourth wire 116, fifth wire 118 and sixth wire 119 extend from the rotating slip ring plug 108, through the cylindrical upper rotating connector section 98, through the cylindrical upper connecting tube 104 to the outside of body 122.

Referring now to FIGS. 4A, 4B1, 4B2, 4C, and 1D, the combined rotatable connector 95 comprises the upper rotating connector section 98 attached to the monitor body 122, and the lower rotating connector section 70 attached to the base element 56. Upper section 98 and lower section 70 are joined when the monitor body 122 and the base element 56 are joined together. The rotating slip ring plug 108 of the upper rotating connector section 98 is inserted into the rotating slip ring jack 88 of the lower rotating connector section 70, so that the first conductive brush 90, second conductive brush 92 and third conductive brush 97 of the rotating slip ring jack 88 contact the electrically conductive first conductive section 110, second conductive section 112 and third conductive section 111 of the rotating slip ring plug 108, respectively. The groove 114 in the tapered section of section of the rotating slip ring plug 108 is releasably held by the securing detent brush 97 of the rotating slip ring jack 88 which is resilient and biased to engage groove 114.

The union of the upper rotating connector section 98 to the lower rotating connector section 70 serves to establish an electrical communication between the first wire 94, extending out of the base element 56, and the fourth wire 116, extending out of the monitor body 122. Electrical communication is also established between the second wire 96, extending out of the base element 56, and the fifth wire 118, extending out of the monitor body 122. Additionally, electrical communication is also established between the third wire 93 extending out of the base element 56, and the sixth wire 119, extending out of the monitor body 122. As the upper connecting tube 104 is fixedly attached to both the upper rotating connector section 98 and the monitor body 122, and the lower connecting tube 80 is fixedly attached to both the lower rotating connector section 70 and the base element 56, rotation of the monitor body 122 upon the base element 56 translates into rotation of the upper rotating connector section 98 inside of the lower rotating connector section 70, and thus the rotating slip ring plug 108 inside the rotating slip ring jack 88. As the rotating slip ring plug 108 rotates in the rotating slip ring jack 88, the first conductive brush 90 of the rotating slip ring jack 88 remains in contact with the first conductive section 110 of the rotating slip ring plug 108. Likewise, the second conductive brush 92 of the rotating slip ring jack 88 remains in contact with the second conductive section 112 of the rotating slip ring plug 108, and third conductive brush 97 remains in contact with third conductive section 111. Therefore, during a rotation event of the monitor body 122 about the base element 56, and subsequent rotational position of the monitor body 122, electrical communication between first wire 94 and fourth wire 116, and second wire 96, fifth wire 118, and third wire 93 and sixth wire 119 remains continuous. Thus, constant rotation of the monitor body 122 about the base element 56 is possible, while maintaining electrical communication between the monitor body 122 and the base element 56. Of course, it is contemplated to switch the position of the rotating slip ring plug 108 and the rotating slip ring jack 88, such that the rotating slip ring plug 108 is attached to the lower rotating connector section 70 and the rotating slip ring jack 88 is attached to the upper rotating connector section 98. It is also contemplated that the positions of the wires may be changed such that the first wire 94 is in communication with the fifth wire 118, and the second wire 96 is in communication with the fourth wire 116, etc.

It should be noted that the first wire 94 and fourth wire 116, the second wire 96 and fifth wire 118 and third wire 93 and sixth wire 119 connections may be energized to provide electricity from an electrical power source (not shown) attached to the first wire 94 and second wire 96, in order to energize electrical components which may be deposited on the monitor body 122, and to provide electrical control signals to the control module 184. The first wire 94 and fourth wire 116, second wire 96 and fifth wire 118, and third wire 93 and sixth wire 119 may also be energized to provide bi-directional communication between electrical components deposited on the monitor body 122 and electrical components deposited on or near the base element 56.

Referring again to FIGS. 1A, 1B, 1C, 1D, 1E, and 6, electronics housing 182 is attached to the monitor body 122. The electronics housing 182 contains a control module 184. The control module 184 contains a microprocessor or other control circuitry. The control module 184 is designed to receive commands via radio frequency signals or through the wires and communicate the commands to control the horizontal drive unit 220 and the vertical drive unit 282 attached to the monitor body 122. The electronics housing 182 contains a plurality of openings with which to facilitate the establishment of communication between the control module 184 and devices external to the electronics housing 182. Each of the plurality of openings is adapted to receive the threaded end of a threaded cable adapter 187, and a gasket 189 is compressed against an annular flange of adapter 187 to create a liquid tight seal as a nut 201 is tighten onto the threaded end of adapter 187. Adapter 187 has a hollow channel through the center thereof adapted to receive an electrical cable and clamp that electrical cable to create a liquid tight seal around the cable.

Additionally, an electronics housing cover 188 is provided, which, when removed, allows access to the control module 184 and electrical connections thereto. The electronics housing cover 188 is attached to the electronics housing 182 by screws. Additionally, a gasket or O-ring is provided between the electronics housing cover 188 and the electronics housing 182, to create a fluid-tight seal when the electronics housing cover 188 is joined to the electronics housing 182.

In a preferred embodiment of the present invention, the first wire 94 and fourth wire 116, second wire 96 and fifth wire 118 and third wire 93 and sixth wire 119, are used to provide electricity and control signals to the control module 184. By utilizing the rotating slip ring plug 108 and the rotating slip ring jack 88 inside the rotating connector assembly, electricity may be provided from an electrical power source (not shown) external to monitor 48 throughout the arc of rotation of body 122. The electrical apparatus (not shown) may be attached to the fourth wire 116 fifth wire 118 or sixth wire 119 extending from the base element 56, where the fourth wire 116 is in constant communication with the first wire 94, fifth wire 118 is in constant communication with the second wire 96, and sixth wire 119 is in constant communication with third wire 93. Thus, the first wire 94, second wire 96 and third wire 93 may carry electricity and command signals to the control module 184 and drive units 220 and 282 and nozzle motor 502 as the monitor body 122 rotates about the base element 56 through out the entire arc of rotation.

An antenna 192 has a screw base, is attached to the electronics housing 182 through an opening in the electronics housing 182, and is of a composition well known in the art. An antenna gasket 194 is preferably deposited into the threaded opening of the electronics housing 182, such that a fluid-tight connection is made between the antenna 192 and the electronics housing 182. The antenna 192 is in electronic communication with the control module 184. The antenna 192 gathers radio signals and conducts the radio signals to the control module 184. In an alternate embodiment of the present invention, the antenna 192 may be energized by the control module 184, to create and transmit radio signals.

Figure 1F:
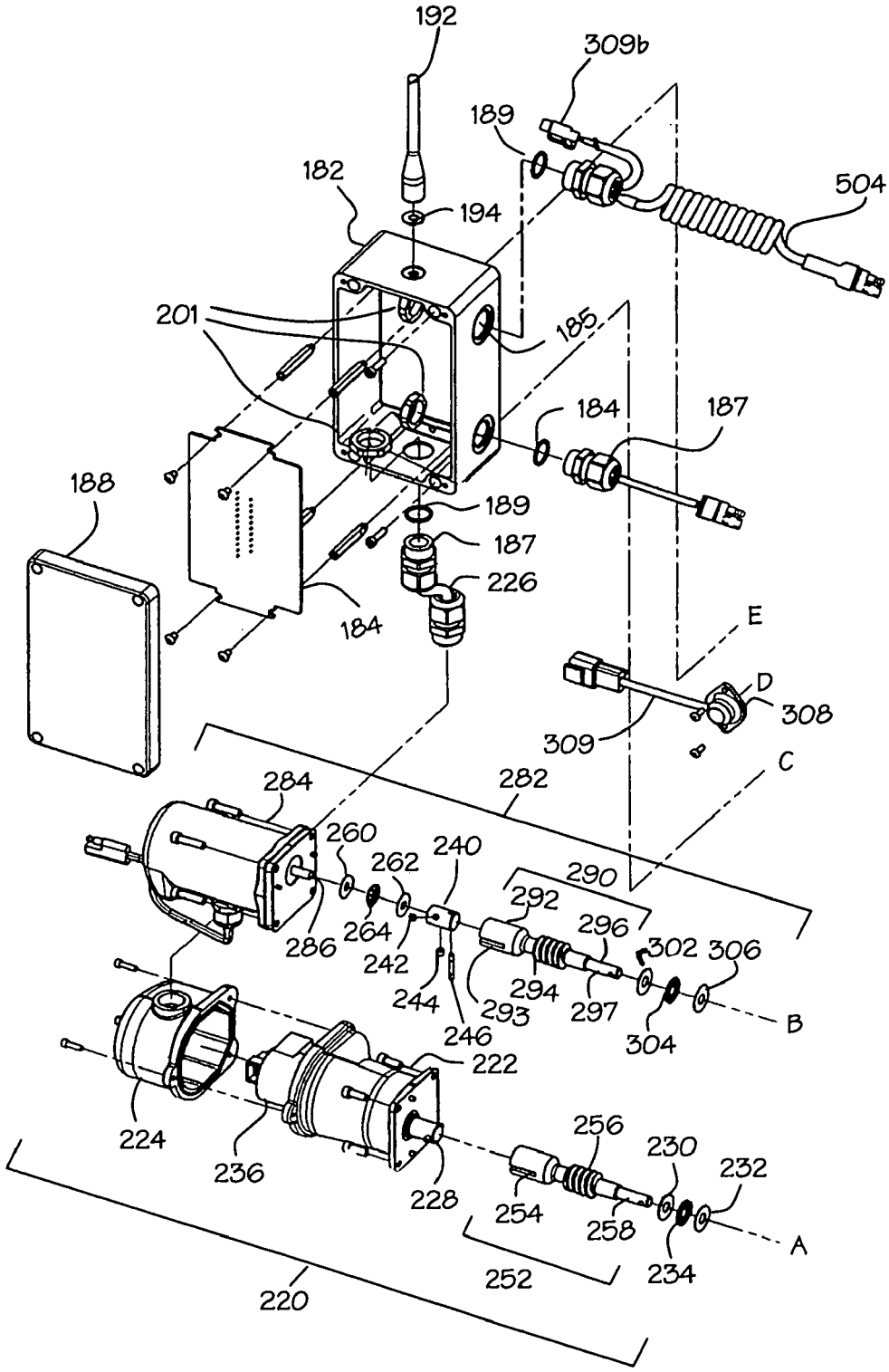
FIG. 1F is a partial exploded perspective view of the radio controlled monitor of FIG. 1A.
Figure 6:
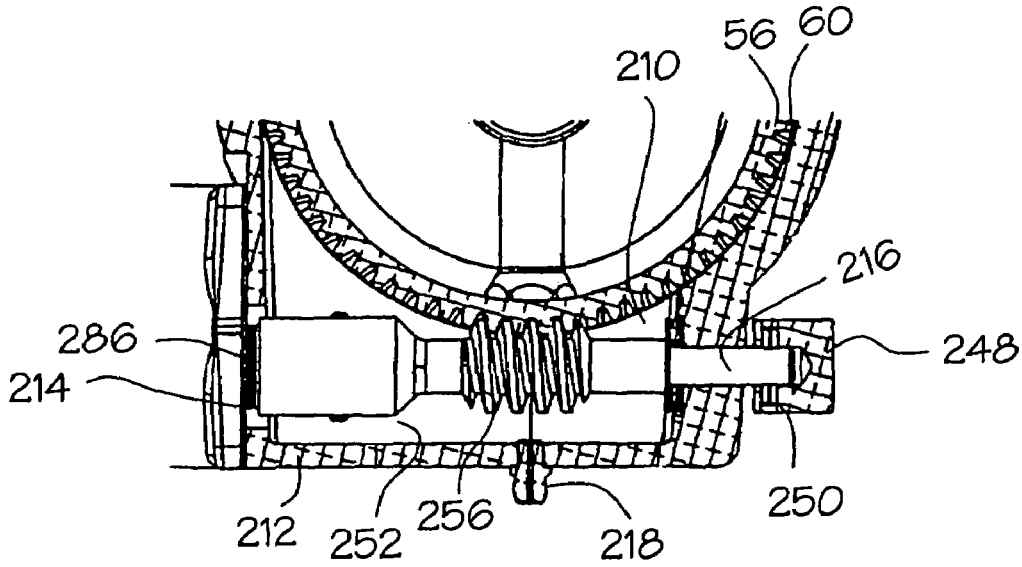
FIG. 6 is a partially fragmentary cross sectional top view of the horizontal worm drive gear of the radio controlled monitor of FIG. 1A.

With reference to FIGS. 1E, 1F, and 6, a horizontal drive opening (not shown) is formed in the monitor body 122, and is positioned adjacent the base element gear teeth 60. This opening is beneath a horizontal drive motor support structure 212 which is integrally formed onto body 122. The horizontal drive motor support structure 212 contains a horizontal drive motor opening 214, a horizontal worm shaft opening 216, and a horizontal drive grease opening 218.

The horizontal drive unit 220 comprises a horizontal drive motor 222, having a horizontal motor drive coupling 228, to provide rotational capability. The horizontal drive motor 222 is electrically controlled by the control module 184, and a connecting cable extends from the horizontal drive motor 222, through a horizontal drive motor cover 224, to the control module 184, through an opening in the bottom of electronics housing 182. The control module 184 may send electrical signals to the horizontal drive motor 222 such that the horizontal drive motor 222 selectively rotates worm 256 in a clockwise or counterclockwise direction and over any rotational arc. The horizontal worm shaft 252 comprises a horizontal worm drive gear cylindrical section 254 into which coupling 228 is inserted, a worm 256, which has a gear pattern complimentary to the gear pattern of gear teeth 60 which circumscribes the base element 56, and a narrowed shaft portion 258. A first thrust washer 230, a first thrust bearing 234, and a second thrust washer 232 are inserted over the narrowed shaft portion 258.

The horizontal drive unit 220 is positioned such that the horizontal worm shaft 252 is inserted into the horizontal drive motor support structure 212 so that worm 256 engages the base element gear teeth 60. The narrowed shaft portion 258 extends through opening 216 of the horizontal drive motor support structure 212. Narrowed shaft portion 258 is engaged by a horizontal drive unit override nut 248, and a horizontal drive unit pin 250 is inserted through the horizontal drive unit override nut 248 and an aperture through the end of narrowed shaft portion 258 to prevent removal of the horizontal drive unit override nut 248 from the narrowed shaft portion 258. The horizontal drive motor 222 may thus be operated to rotate the horizontal worm shaft 252 inside of the monitor body 122, so that worm 256 engages with the base element gear teeth 60.

Integrated into the horizontal drive motor 222 is a feedback encoder 236. The feedback encoder 236 conveys control signals to the control module 184 via the electrical connection of the control module 184 to the horizontal drive motor 222. The information sent to the control module 184 consists of rotational information for the horizontal motor drive coupling 228. As an example, the following scenario illustrates the operation of the feedback encoder 236: the control module 184 energizes the horizontal drive motor 222 to operate on the horizontal motor drive coupling 228 in a clockwise direction. The feedback encoder 236 relays data regarding the rotation of the horizontal motor drive coupling 228 back to the control module 184. When the control module 184 receives data from the feedback encoder 236 which indicates the monitor body 122 has rotated 30 degrees clockwise, the control module 184 powers down the horizontal drive motor 222, stopping the rotation.

Figure 5:
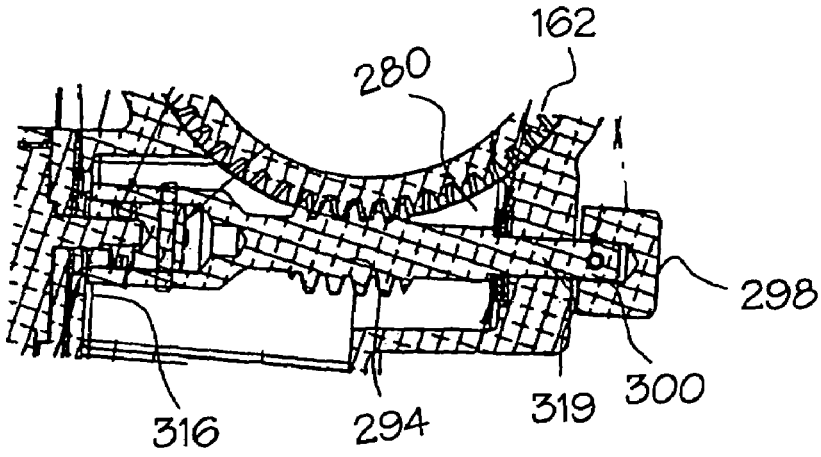
FIG. 5 is a partially fragmentary cross sectional side view of the vertical worm drive gear of the radio controlled monitor of FIG. 1A.

Referring now to FIGS. 1E, 1F, and 5, a vertical drive opening (not shown) is present in the monitor body 122, and is positioned over the discharge elbow gear teeth 162. This opening is covered by a vertical drive motor support structure 314 which is integrally formed to body 122. The vertical drive motor support structure 314 contains a vertical drive motor opening 316, a vertical worm shaft opening 319, and a vertical drive grease opening 320.

The vertical drive unit 282 comprises a vertical drive motor 284, with a vertical motor drive shaft 286, to provide rotational capability. The vertical drive motor 284 is electrically controlled by the control module 184, and a cable extends from the vertical drive motor 284 to the control module 184, through an opening in the electronics housing 182. Each of the plurality of openings is adapted to receive the threaded end of a threaded cable adapter 187, and a gasket 189 is compressed against an annular flange of adapter 187 to create a liquid tight seal as a nut 201 is tightened onto the threaded end of adapter 187. Adapter 187 has a hollow channel through the center thereof adapted to receive an electrical cable and clamp that electrical cable to create a liquid tight seal around the cable. The control module 184 may send electrical signals to the vertical drive motor 284 such that the vertical drive motor 284 is operable on the vertical motor drive shaft 286, to rotate the vertical motor drive shaft 286 in a clockwise or counterclockwise direction and over any rotational arc.

Placed over the vertical motor drive shaft 286 are a third thrust washer 260, a second thrust bearing 264, and a fourth thrust washer 262. Also attached to the motor drive shaft is a shaft coupling 240. The shaft coupling 240 is cylindrical, and contains three openings. A fifth set screw 242 and a sixth set screw 244 are inserted into openings in the shaft coupling 240. Attached to the shaft coupling 240 is a vertical worm shaft 290. A drive pin 246 is inserted through the shaft coupling 240, to engage slot 243 in cylindrical section 292. The vertical worm shaft 290 comprises a vertical worm cylindrical section 292, into which the shaft coupling 240 is inserted, a vertical worm 294, which is threaded with a thread pattern complimentary to the discharge elbow gear teeth 162, and a narrowed shaft portion 296, which has an aperture 297 formed through one end thereof. A fifth thrust washer 302, a third thrust bearing 304, and a sixth thrust washer 306 are inserted over narrowed shaft portion 296.

The vertical drive unit 282 is positioned so that worm shaft 290 is inside the vertical drive motor support structure 314, such that the vertical worm drive gear 294 engages the discharge elbow gear teeth 162. The end of the narrowed shaft portion 296 extends from shaft opening 319 of the vertical drive motor support structure 314. An override nut 298 is placed over the end of narrowed shaft portion 296, and a vertical drive unit pin 300 is inserted through the vertical drive unit override nut 298 and aperture 297, to prevent removal of the vertical drive unit override nut 298 from the end of narrowed shaft portion 296. The vertical drive motor 284 may thus be operated to rotate the vertical worm shaft 290 inside of the monitor body 122, to engage with the discharge elbow gear teeth 162, to cause elbow 160 to rotate about a horizontal axis.

A Hall sensor 308 is attached over an opening 317 in the monitor body 122, and is positioned adjacent the discharge elbow gear teeth 162. Attached to the Hall sensor 308 is a wire, 309*a* and 309*b*, which are in electrical communication with the control module 184, via an opening 185 in the electronics housing 182. The opening in the electronics housing 182 preferably contains a gasket that creates a fluid-tight seal against the body 122. A first magnet 172 and a second magnet 174 are deposited into recesses along the perimeter of one end of discharge elbow 160, and rotate with relation to the Hall sensor 308 when the worm shaft 290 operates to rotate the discharge elbow 160. The Hall sensor 308 detects the proximity of the first magnet 172 and the second magnet 174, and communicates that positional information to the control module 184. As an example, the following scenario illustrates the operation of the Hall sensor 308: the control module 184 energizes the vertical drive motor 284 to operate on the vertical motor drive shaft 286 in a clockwise direction. The Hall sensor 308 relays a signal when the rotation of the discharge elbow 160 reaches the limits of travel which are defined by the position of first and second magnets 172 and 174. When the control module 184 receives a signal from the Hall sensor 308 which indicates the discharge elbow 160 has rotated to one of those limits, the control module 184 powers down the vertical drive motor 284 stopping the rotation of elbow 160.

With reference to FIG. 1B, nozzle motor 502 may be electrically connected to the control module 184 with cables 504 in the same manner as horizontal drive motor 222 and vertical drive motor 284. Control module 184 can control the operation of nozzle motor 502 through commands received by the control module 184 to vary the pattern of the spay of the nozzle.

Figure 7A:
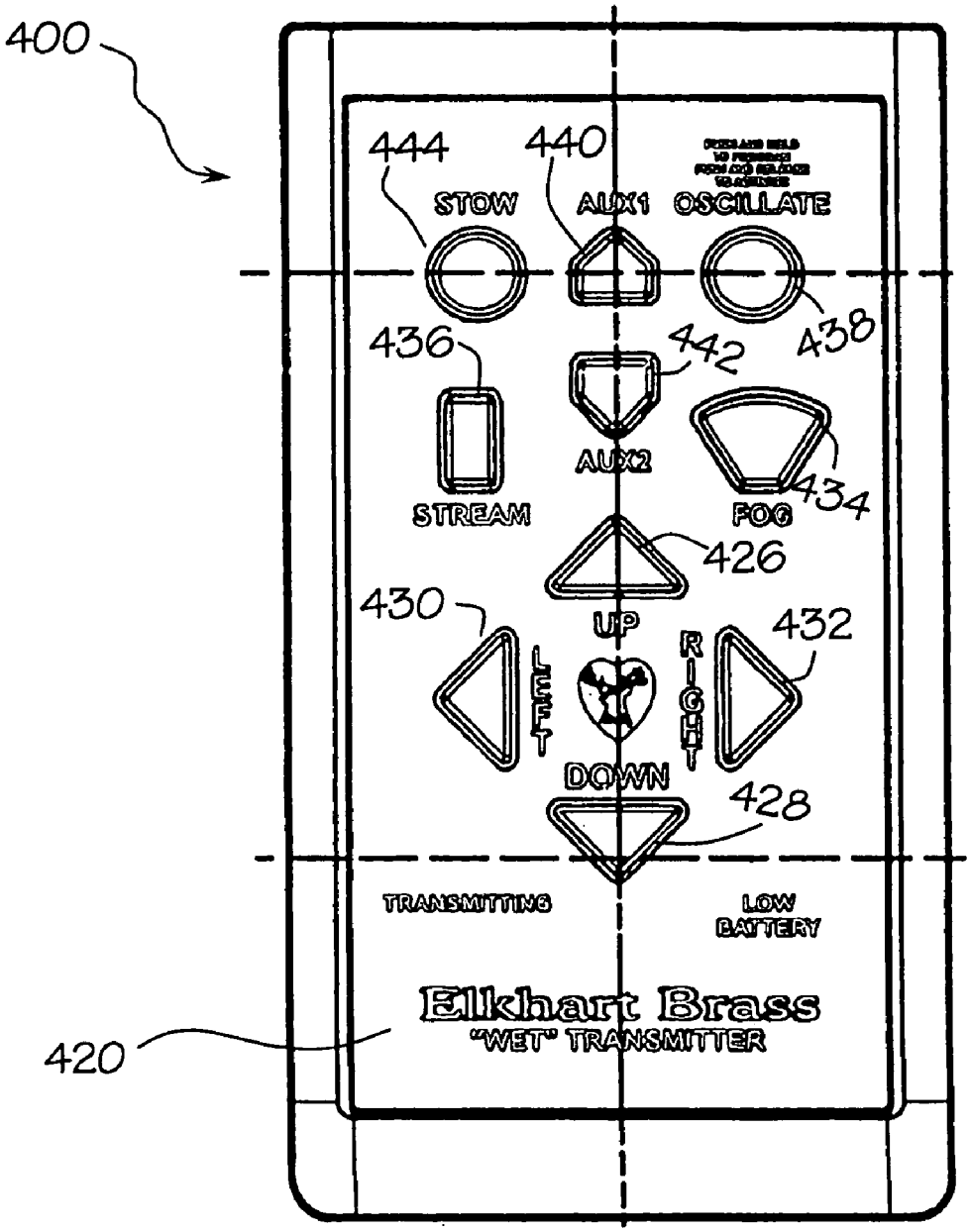
FIG. 7A is a front view of a portable transmitter apparatus for the radio controlled monitor of FIG. 1A.
Figure 7B:
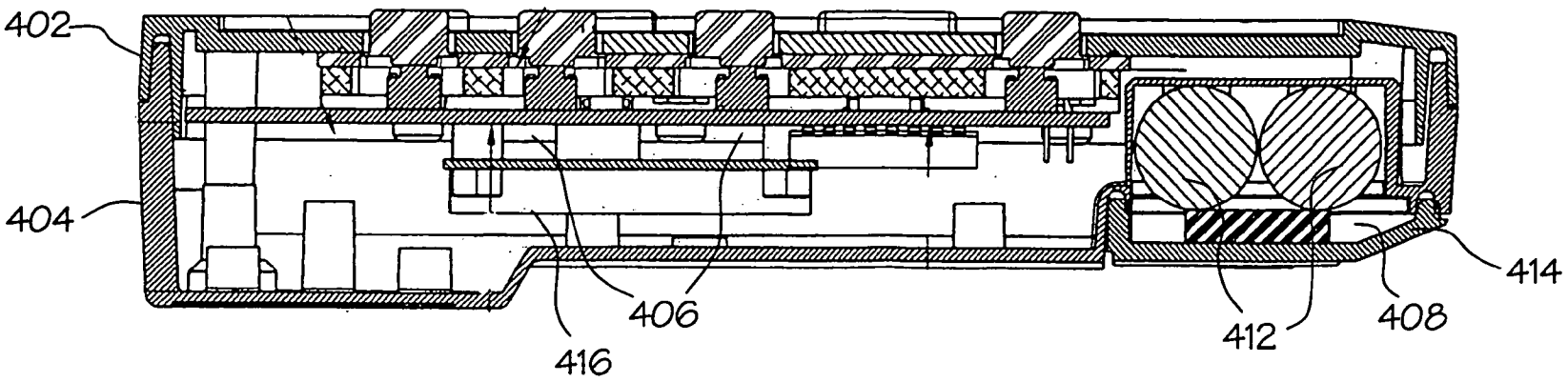
FIG. 7B is a cross sectional side view of the portable transmitter apparatus of FIG. 7A.

Referring now to FIGS. 7A and 7B, the portable transmitter apparatus 400 is provided to enable human operation of the radio controlled monitor 48. The external structure of the portable transmitter apparatus 400 consists of an upper frame 402 and a lower frame 404. The upper frame 402 and the lower frame 404 are attached to each other by screws (not shown) or another method to form a cavity 406 and a battery cavity 408. One or more batteries 412 are deposited inside the battery cavity 408, and the battery cavity 408 is covered by a battery door 414, which releasably attaches to the upper frame 402 and lower frame 404 combination. Inside the cavity 406 is a microprocessor (not shown), which receives electricity from electrical connections to the batteries 412, and an antenna (not shown), which is in electrical communication with the microprocessor (not shown). In the upper frame 402 are a plurality of openings into which a plurality of protrusions from a key pad are positioned. Each protrusion is position over a switch (not shown) which is in communication with the microprocessor (not shown). The switches (not shown) may be depressed individually, such that each button (not shown) is recognized individually by the microprocessor (not shown). Upon depression of a button (not shown), the microprocessor (not shown) identifies the button (not shown) depressed, and energizes the antenna (not shown) to transmit a specific coded sequence, based on the button (not shown) depressed. The antenna (not shown) may transmit the coded sequence for as long as the button (not shown) is depressed. Text 420 is printed on the upper frame 402, or on a decal (not shown) which is affixed to the upper frame 402, to identify functionality associated with each button (not shown).

Figure 8A:
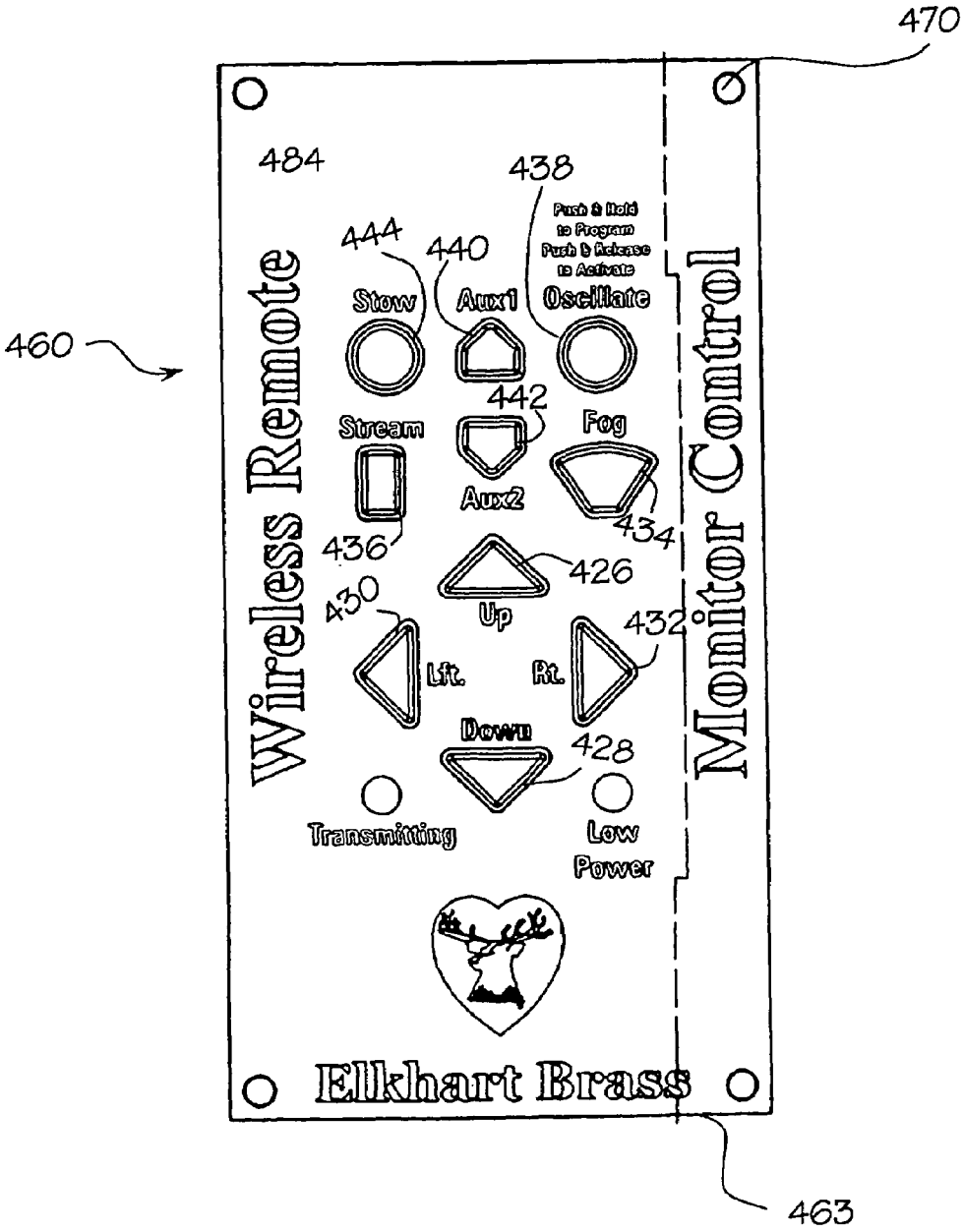
FIG. 8A is a front view of a fixed transmitter apparatus for the radio controlled monitor of FIG. 1A.
Figure 8B:
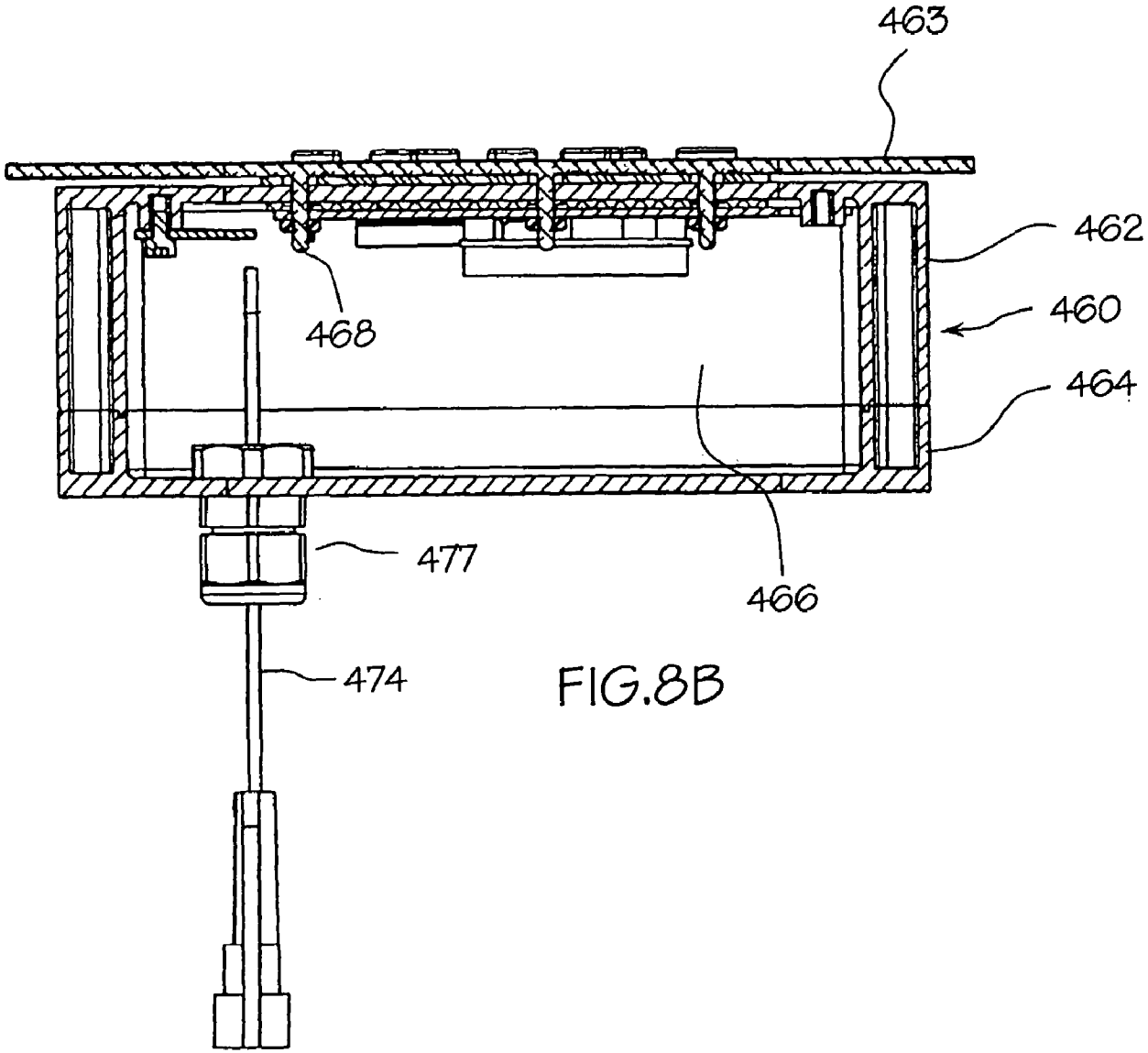
FIG. 8B is a cross sectional view of the fixed transmitter apparatus of FIG. 8A.

Referring now to FIGS. 8A and 8B, the fixed transmitter apparatus 460 is provided to allow human operation of the radio controlled monitor 48 from a control unit affixed to a structure. The external structure of the fixed transmitter apparatus 460 consists of an upper frame 462 and a lower frame 464. The upper frame 462 and the lower frame 464 are attached to each other by screws (not shown) or any other method to form a cavity 466. Attached to the face of upper frame 462 is a cover 463. The upper frame 462 and lower frame 464 contains a plurality of holes (not shown) so that the fixed transmitter apparatus 460 may be attached to a structure (not shown) by fasteners positioned through the holes. An opening is formed in the lower frame 464, which accepts a connector 477, and allows cable 474 to pass through the lower frame 464, into the cavity 466. The cable 474 is attached to an external electrical power source (not shown), which provides electricity to the fixed transmitter apparatus 460. Inside the cavity 466 is a microprocessor (not shown), which receives electricity from the cable 474 extending through the lower frame 464, to an external electrical system (not shown), and an antenna, which is in electrical communication with the microprocessor (not shown). Cover 463 and upper frame 462 have a plurality of aligned openings (not shown) formed there through. Deposited into each of the plurality of openings is a protrusion of a key pad, each protrusion is positioned over a switch (not shown) which are in communication with the microprocessor (not shown). The protrusions and underlying switches may be depressed individually, such that each switch is recognized individually by the microprocessor (not shown). Upon depression of a switch, the microprocessor (not shown) identifies which switch has been depressed, and energizes the antenna to transmit a specific coded sequence, based on which switch depressed. The antenna may transmit the coded sequence for as long as the switch is depressed. Text is printed on the cover 463, or on a decal which is affixed to the cover 463, to identify functionality associated with each protrusion and underlying switch.

It should be noted that either the portable transmitter apparatus 400 or the fixed transmitter apparatus 460 may provide control of the radio controlled firefighting apparatus 48. Either the portable transmitter apparatus 400 or the fixed transmitter apparatus 460 can constitute the remote control device. It should also be noted that the switches present on the portable transmitter apparatus 400 and the fixed transmitter apparatus 460 have identical reference numerals; this is to indicate similar functionality, herein described. Both the portable transmitter apparatus 400 and the fixed transmitter apparatus 460 transmit security code information to the control module 184. The security code information may be individualized for each individual radio controlled monitor 48, such that multiple transmitters may be used in conjunction with multiple radio controlled monitors 48 without causing interference with each other. Further, the use of security codes may prevent improper operation using devices other than the transmitters.

A human operator directs the functionality of the radio controlled monitor 48 from a portable transmitter apparatus 400 or a fixed transmitter apparatus 460. This direction is accomplished by depressing one of the switches of the remote control device. As stated above, depressing one of the switches of the remote control device prompts the microprocessor to identify the button being depressed, and energize the antenna, to transmit a coded sequence, unique to the depressed button. The coded sequence is received by the antenna 192 mounted on the radio controlled monitor 48, and the control code is conducted to the control module 184. The control module 184 contains a list of the control codes which may be transmitted, and an action to take in response to each of the control codes. The control module 184 thus operates on attached components to realize the action communicated from the remote control. Associated with a number of the control codes is the concept of "press and hold" functionality, where the control module 184 may continue to take the action for as long as the control code is received. Such "press and hold" functionality is well known in the remote control apparatus art.

A preferred embodiment of the present invention contains a plurality of key pad button protrusions associated with specific switches, and thus a plurality of functionalities, associated with a remote control unit. A set of directional buttons, consisting of "Up" 426, "Down" 428, "Left" 430, and "Right" 432 buttons, are arranged on the remote control device. The directional buttons direct the control module 184 to operate on the horizontal drive motor 222 and vertical drive motor 284, to change the direction of the fluid output stream. The "Up" 428 button causes the control module 184 to energize the vertical drive motor 284 to rotate worm shaft 290 in a directed which results in rotating the end of discharge elbow 160 upwardly. The "Down" 428 button causes the control module 184 to energize the vertical drive motor 284 to rotate worm shaft 290 in the opposite direction which results in moving the end of discharge elbow 160 downwardly. The "Left" 432 button causes the control module 184 to energize the horizontal drive motor 222 to cause the horizontal worm shaft 252 to rotate in a direction which results in moving the monitor body 122 counter clockwise as looking down from above. The "Right" 432 button causes the control module 184 to energize the horizontal drive motor 222 to rotate the horizontal worm shaft 252 in the opposite direction, which results in moving the monitor body 122 clockwise as looking down from above. The directional buttons have additional "press and hold" functionality, such that the continuous depression of one of the directional buttons directs the control module 184 to energize the horizontal drive motor or vertical drive motor 284 to operate in either the clockwise or counterclockwise direction continuously until the button is released or an electronic limit is reached.

The "Stow" 444 button causes the control module 184 to energize both the horizontal drive motor 222 and the vertical drive motor 284, to rotate the monitor body 122 and the discharge nozzle into a pre-programmed "storage" position. Such a positioning may be useful when the monitor 48 is being moved to different locations or being stored during non-use.

The "Oscillate" 438 button causes the control module 184 to energize the horizontal drive motor 222 in an alternating clockwise and counterclockwise rotation, such that the monitor body 122 rotates in a back-and-forth motion over a pre-determined arc. The "Oscillate" 438 button may have additional "press and hold" functionality, such that electronic limits of pre-determined arc of oscillating motion may be pre-recorded or programmed using the "Left" 430 and "Right" 432 directional buttons. Thus, a right and left limit of travel for oscillation can be programmed on a case to case basis using the transmitter apparatus. Thus, the need to set mechanical limits is avoided. The oscillation function is very desirable for a number of operations where constant manned control is not needed. For example, the oscillation feature could be used to saturating an area of a burning building in an attempt to control a fire or for spraying a roof of a building adjacent a burning building to prevent it from catching on fire.

In addition to programmable electronic limits of travel for oscillation the control module 184 also has programmable maximum electronic limits of travel that can not be varied using the remote control transmitter apparatus. These electronic limits can only be changed by removing the cover 188 to gain access the control module 184 inside housing 182, and are not able to be changed during normal operations. These maximum electronic limits of travel prevent the user from accidentally hitting an adjacent object or piece of equipment on the truck or other structure to which the monitor is mounted. Conventional prior art monitors required mechanical stops to set limits of travel to avoid striking adjacent objects. These electronic limits can be varied or eliminated as the user desires depending on the surrounding structures, but can only be changed by removing cover 188 and accessing the control module 184.

The "Stream" 436 and "Fog" 434 buttons cause the control module 184 to regulate the nozzle motor 502 to control the pattern in which fluid is ejected from the nozzle 500. For example, the fluid may be ejected in a narrow stream pattern (Stream), or may be ejected in a fine spray or a mist (Fog).

The "Aux1" 440 and "Aux2" 442 buttons are present for future expansion of the functionality of the radio controlled monitor 48.

Although other advantages may be found and realized and various modifications may be suggested by those versed in the art, it is understood that the present invention is not to be limited to the details given above, but rather may be modified within the scope of the appended claims.

What is claimed is:

1. An apparatus for conveying and directing a fluid to a desired location comprising:

a base element having a first hollow conduit formed therethrough, said first conduit having a first end and a second end, said first end adapted to be connected to a source of fluid;

a rotatable body rotatably mounted to said base element, said rotatable body having a second hollow conduit formed therethrough, said second conduit having a first end and a second end, said first end of said second conduit communicates with the second end of the first hollow conduit, said rotatable body capable of rotation about a vertical axis through an arc;

a discharge elbow rotatably mounted to said rotatable body, said discharge elbow having a third hollow conduit formed therethrough, said third conduit having a first end and a second end, said first end of said third conduit communicates with said second end of said second conduit, said second end of said third conduit terminating at a discharge opening which directs discharge of the fluid in a desired direction, said discharge elbow being capable of rotation about a horizontal axis through an arc; and a control module capable of receiving control signal commands, said control module operably connected to a horizontal drive apparatus and a vertical drive apparatus so that said control module may provide control signals to said horizontal drive apparatus and said vertical drive apparatus in response to receipt of radio control signal commands to control the rotation of said rotatable body and said discharge elbow; said control module further capable of causing said rotatable body to rotate back and forth in oscillation between predetermined limits established electronically by said control module.

2. The apparatus of claim 1 wherein said predetermined limits are variable and can be programmed into said control module.

3. The apparatus of claim 1 wherein said predetermined limits are variable and can be programmed into a transmitter in communication with said control module.

* * * * *